US008434192B2

(12) United States Patent
Dondurur et al.

(10) Patent No.: US 8,434,192 B2
(45) Date of Patent: May 7, 2013

(54) SHIELD FOR PAINT ROLLER

(75) Inventors: Mehmet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 144 days.

(21) Appl. No.: 13/089,084

(22) Filed: Apr. 18, 2011

(65) Prior Publication Data

US 2012/0260449 A1 Oct. 18, 2012

(51) Int. Cl.
*A46B 17/00* (2006.01)

(52) U.S. Cl.
USPC ..... 15/248.2; 15/230.11; 15/246

(58) Field of Classification Search ..... 15/248.1, 15/248.2, 230.11, 246
See application file for complete search history.

(56) References Cited

U.S. PATENT DOCUMENTS

| | | | | |
|---|---|---|---|---|
| 1,861,179 | A | 5/1932 | Gray | |
| 3,115,659 | A | 12/1963 | Church | |
| 3,409,929 | A | 11/1968 | Fisher | |
| 3,599,268 | A * | 8/1971 | Simpkins et al. | 15/230.11 |
| 3,623,180 | A | 11/1971 | Anderson | |
| 3,748,683 | A * | 7/1973 | Smith et al. | 15/248.2 |
| 4,063,325 | A | 12/1977 | Lizak | |
| 4,571,769 | A | 2/1986 | Ford | |
| D336,370 | S * | 6/1993 | Hunt | D4/116 |
| 5,444,891 | A | 8/1995 | Benson | |
| 5,623,740 | A | 4/1997 | Burns et al. | |
| 5,845,359 | A | 12/1998 | Weiss | |
| 5,864,918 | A | 2/1999 | Kosick | |
| 5,960,511 | A | 10/1999 | Boyce | |
| D443,986 | S | 6/2001 | Marino | |
| D473,056 | S | 4/2003 | Prince et al. | |
| 6,579,587 | B2 | 6/2003 | Schnoebelen, Jr. | |
| 6,739,017 | B1 | 5/2004 | Johnson | |
| 7,181,802 | B2 | 2/2007 | Kosick | |
| 7,340,796 | B2 | 3/2008 | Pyles | |
| D602,696 | S | 10/2009 | Morad et al. | |
| 7,638,015 | B2 | 12/2009 | Schnoebelen, Jr. | |

* cited by examiner

*Primary Examiner* — Shay Karls
(74) *Attorney, Agent, or Firm* — Richard C. Litman

(57) ABSTRACT

The shield for a paint roller protects both the user and the environment from accidental spills or splashes of paint when using a paint roller. The shield includes a frame member having a pair of opposed side edges, a front edge and a rear edge. A front wall is mounted to the front edge of the frame member and extends substantially orthogonal to the frame member. A rear wall is mounted to the rear edge of the frame member, the rear wall being substantially parallel to the front wall so that an open region is defined between the front and rear walls for releasably receiving the roller brush of the paint roller therebetween. An upper portion and a lower portion of the roller brush remain exposed when the shield is mounted on the paint roller. The frame member is releasably secured to an axle of the paint roller.

10 Claims, 3 Drawing Sheets

SHIELD FOR PAINT ROLLER

BACKGROUND OF THE INVENTION

1. Field of the Invention

The present invention relates to tools for building construction and remodeling, and particularly to a shield for a paint roller to prevent unwanted drips and spills of paint during the painting process.

2. Description of the Related Art

When painting with a conventional paint brush or paint roller, both the painter and the general environment about the painter often become covered with unwanted drips and splashes of paint. Particularly when using a paint roller, since the paint roller is fully exposed and used in a variety of angles and strokes, unwanted paint can drip both on the painter's arm and also on the floor or other surfaces, which are not to be painted.

Such unwanted paint can permanently damage flooring, furniture, etc., and can be hazardous to the painter. It would be desirable to provide a shield for paint rollers, which leaves the direct contact portions of, the paint roller exposed, but which effectively prevents accidental drips of unwanted paint.

Thus, a shield for a paint roller solving the aforementioned problems is desired.

SUMMARY OF THE INVENTION

The shield for a paint roller protects both the user and the environment from accidental spills or splashes of paint when using a paint roller. The shield includes a frame member having a pair of opposed side edges, a front edge and a rear edge. A front wall is mounted to the front edge of the frame member and extends substantially orthogonal to the pair of opposed side edges, the front edge and the rear edge thereof Preferably, the front wall has an upper portion and a lower portion, the upper portion extending upward from the front edge of the frame member and having a height approximately equal to the radius of the roller brush. The lower portion extends downward from the front edge of the frame member and has a height less than the radius of the roller brush.

A rear wall is mounted to the rear edge of the frame member, the rear wall being substantially parallel to the front wall so that an open region is defined between the front and rear walls for releasably receiving the roller brush of the paint roller therebetween. An upper portion and a lower portion of the roller brush remain exposed when the shield is mounted on the paint roller. The frame member is releasably attached to an axle of the paint roller.

An alternative embodiment of the shield for a paint roller includes a pair of opposed sidewalls, with each sidewall having an upper edge, a front edge and a lower edge. The lower edge of at least one of the sidewalls has a pair of recesses formed therein, one of the recesses being adapted for releasably receiving the axle of the roller brush of the paint roller, and the other recess being adapted for releasably receiving a portion of a supporting member of the paint roller adjacent the axle.

An upper wall extends between front portions of the upper edges of the pair of opposed sidewalls. A front wall extends between the front edges of the pair of opposed sidewalls so that a lower portion of the roller brush of the paint roller is exposed. A central support member having opposed front and rear ends is further provided, the front end thereof being attached to the upper wall. The rear end thereof is releasably attached to the supporting member of the paint roller adjacent the handle portion thereof.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
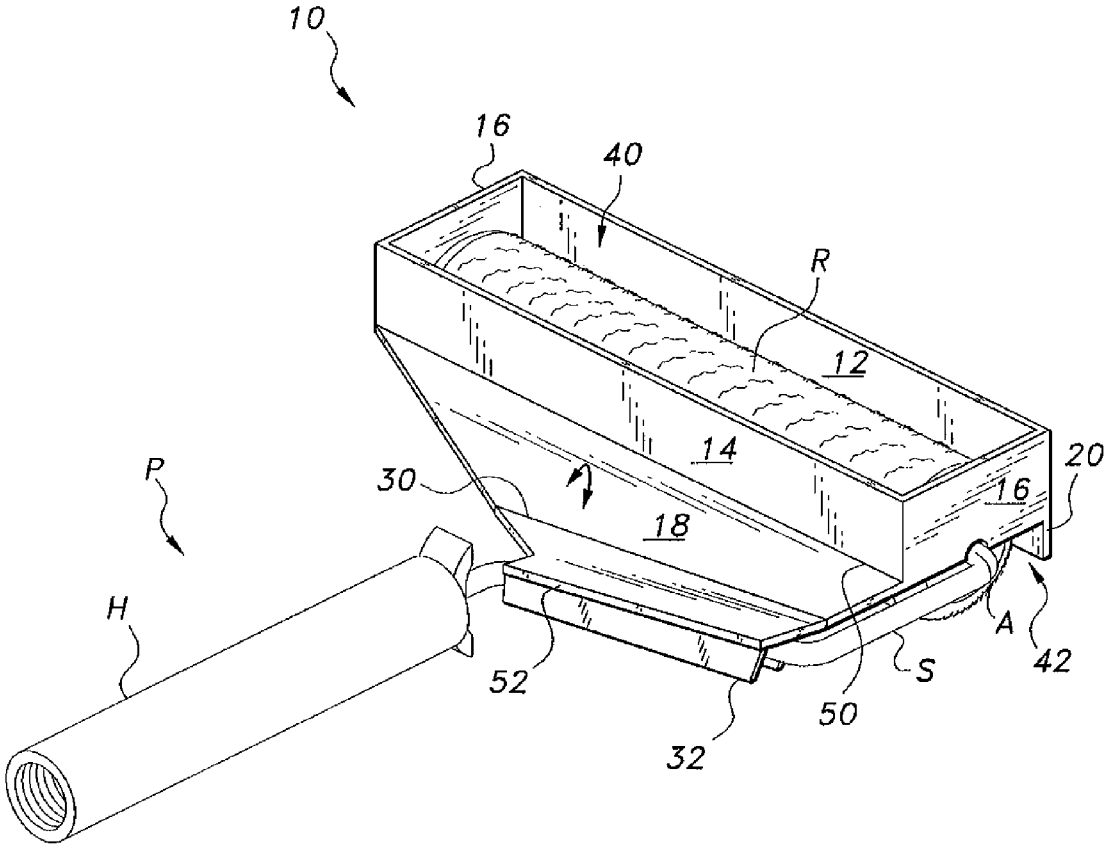
FIG. 1 is an environmental perspective view of a shield for a paint roller according to the present invention.
Figure 2A:
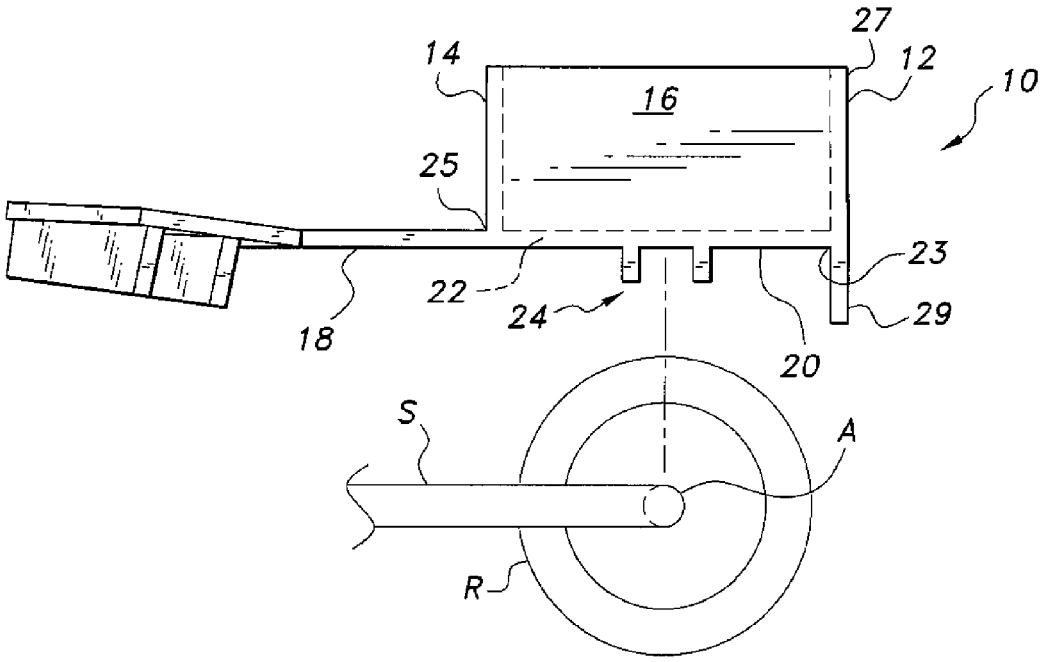
FIG. 2A is an environmental side view of the shield of FIG. 1.

As shown in FIG. 1, the shield 10 for a paint roller P protects both the user and the environment from accidental spills or splashes of paint when using the paint roller P. As best shown in FIG. 2A, the shield 10 includes a frame member 20 having a pair of opposed side edges 22, a front edge 23 and a rear edge 25. A front wall 12 is mounted to the front edge 23 of the frame member 20 and extends substantially orthogonal to the pair of opposed side edges 22, the front edge 23 and the rear edge 25 (i.e., in the orientation of FIG. 2A, the frame member 20 defines a first plane, and the plane of the front wall 12 is orthogonal to that first plane).

It should be understood that paint roller P is shown for exemplary purposes only, and that the shape and relative dimensions of shield 10 may be vary, depending upon the type of paint roller used. As best shown in FIG. 2A, the front wall 12 preferably has an upper portion 27 and a lower portion 29, the upper portion 27 extending upward from the front edge 23 of the frame member 20 and having a height approximately equal to the radius of the roller brush R of paint roller P (or slightly greater than the radius of roller brush R). The lower portion 29 extends downward from the front edge 23 of the frame member 20 and has a height less than the radius of the roller brush R (i.e., less than the height of the upper portion 27). Preferably, the lower portion 29 has a height of approximately two-thirds the radius of the roller brush R.

For a typical cylindrical roller brush R, the frame member 20 is substantially rectangular, and each of the front and rear walls 12, 14, respectively, also is substantially rectangular. Preferably, a pair of sidewalls 16 are also provided, which extend upward from the side edges 22 of frame 20 and extend between the front and rear walls 12, 14, The rear wall 14 is mounted to the rear edge 25 of the frame member 20, the rear wall 14 being substantially parallel to the front wall 12 so that an open region is defined between the front and rear walls 12, 14, respectively, for releasably receiving the roller brush R of the paint roller P therebetween. The rear wall 14 has a height, which is approximately equal to the radius of the roller brush R (or just slightly greater than the radius of roller brush R). As shown in FIG. 1, an upper portion and a lower portion of the roller brush remain exposed when the shield 10 is mounted on the paint roller P (i.e., the shield has an open upper end 40 and an open lower end 42). As shown, the front and rear walls 12, 14, respectively, are spaced apart a distance that is preferably slightly greater than the diameter of roller brush R.

Figure 2B:
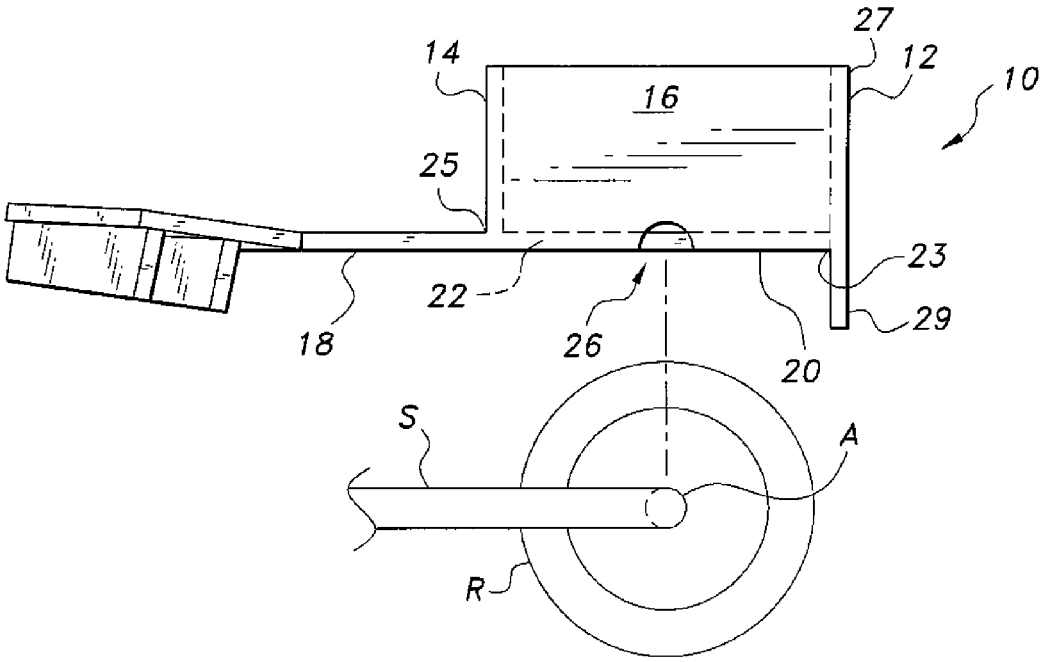
FIG. 2B is a side environmental view of an alternative embodiment of a shield for a paint roller according to the present invention.

The frame member 20 is releasably secured to an axle A of the paint roller P. In FIG. 2A, a clip 24 is mounted to side edge 22 of frame member 20 for releasably receiving the axle A. It should be understood that any suitable type of releasable fastener may be used. For the exemplary paint roller P of FIG. 1, only a single such clip 24 is required on the side of frame member 20 adjacent the side portion of support S of the paint roller P. It should be understood that additional clips 24 may be used, depending upon the particular configuration of the paint roller to which the shield 10 is applied. FIG. 2B illustrates an alternative fastener in the form of a curved central portion 26 of side edge 22 of frame member 20. The curved portion is substantially semicircular, having a diameter approximately equal to that of axle A for releasable, frictional engagement therewith. As noted above, only a single such curved central portion 26 in only one of side edges 22 is required for the exemplary paint roller P of FIG. 1, although a similar curved central portion 26 may be formed in the opposed side edge, depending upon the particular configuration of the paint roller.

Additionally, an auxiliary cover sheet 18 may be further provided, the auxiliary cover sheet having opposed front and rear edges, 50, 52, respectively. The front edge 50 is attached to the rear edge 25 of the frame member 20, and the rear edge 52 of the auxiliary cover sheet 18 is releasably attached to the supporting member S of the paint roller adjacent a handle portion H. Preferably, at least one auxiliary clip 32 is mounted to the rear edge 52 for releasable engagement with the supporting member S, although it should be understood that any suitable type of releasable fastener may be used. Additionally, a fold line 30 is preferably formed in the auxiliary cover sheet 18 adjacent the rear edge 52 thereof. In use, when the user desires to dip the roller brush R into a paint reservoir, the auxiliary cover sheet 18 (and the remainder of shield 10) may be flipped up about the fold line 30 to fully expose the roller brush R.

The shield 10 may be formed from any suitable type of paint-impervious material, such as relatively thin plastic (either clear or opaque), thin metal (such as thin sheets of aluminum or steel), paper, cardboard or thin wood.

Figure 3:
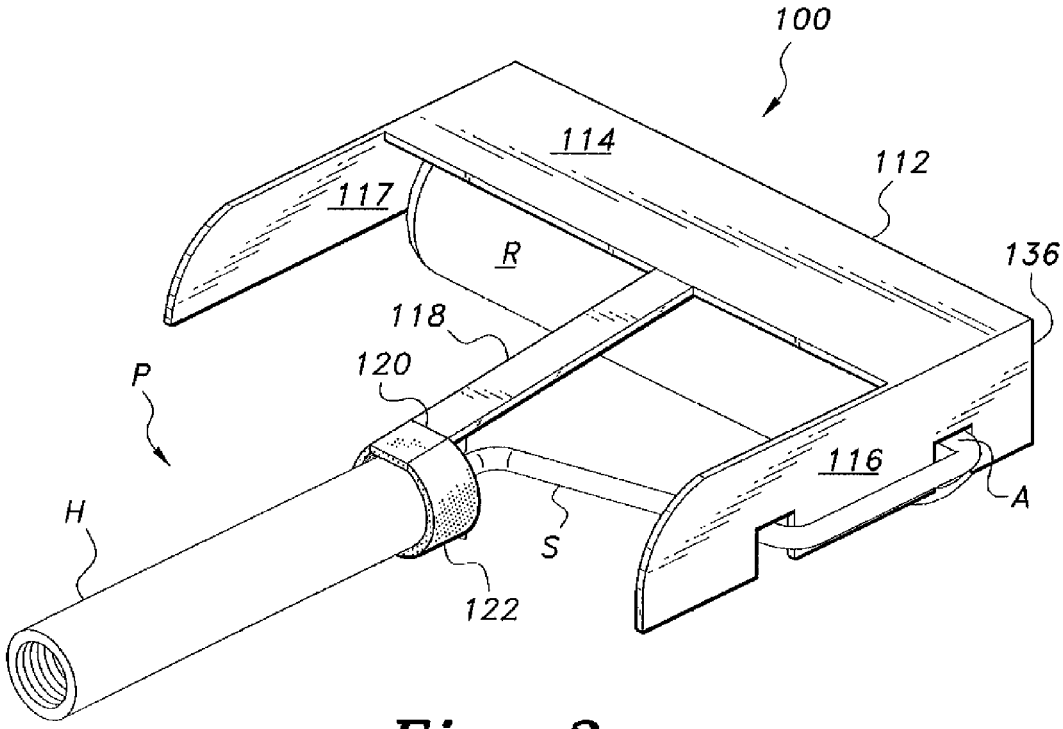
FIG. 3 is an environmental perspective view of another alternative embodiment of a shield for a paint roller according to the present invention.
Figure 4:
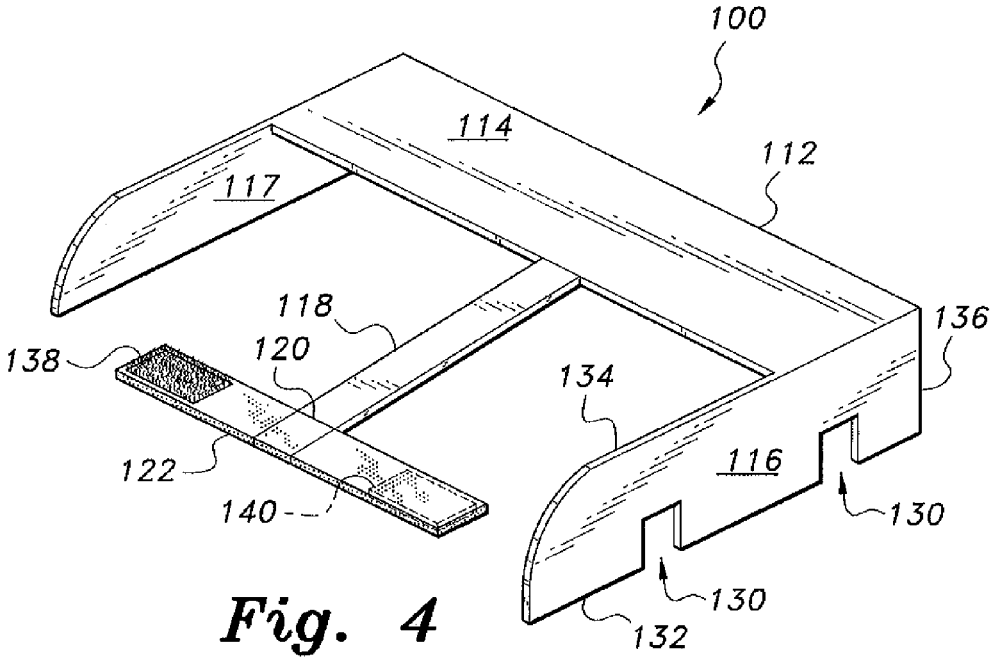
FIG. 4 is a perspective view of the shield of FIG. 3.

An alternative shield 100 is shown in FIGS. 3 and 4. The shield 100 includes a pair of opposed sidewalls 116, each sidewall 116 having an upper edge 134, a front edge 136 and a lower edge 132. The lower edge 132 of at least one of the sidewalls 116 has a pair of recesses 130 formed therein, one of the recesses being adapted for releasably receiving the axle A of the roller brush R of the paint roller P, and the other recess being adapted for releasably receiving a portion of a supporting member S of the paint roller P adjacent the axle A. For the exemplary paint roller P of FIG. 3, the recesses 130 are only formed in one sidewall 116, the other sidewall having a continuous, substantially linear lower edge 132. It should be understood that similar recesses 130 may be formed in the opposite sidewall, depending upon the particular configuration of paint roller used.

An upper wall 114 is extends between front portions of the upper edges 134 of the pair of opposed sidewalls 116. The upper wall 114 preferably only partially covers the roller brush R. A front wall 112 is extends between the front edges 136 of the pair of opposed sidewalls 116 so that a lower portion of the roller brush R of the paint roller P is exposed when the shield 100 is in place.

A central support member 118 is further provided, the central support member 188 having opposed front and rear ends, the front end thereof being attached to a central portion of the upper wall 114, with the central support member 118 extending rearward. The rear end thereof is releasably attached to the supporting member S of the paint roller P adjacent the handle portion H.

The rear end of the central support member 118 may be releasably attached to the supporting member S by any suitable type of releasable fastener. Preferably, a strap 122 is mounted to the rear end so that the strap 122 may be wrapped about the supporting member S adjacent the handle portion H. The strap 122 may be securely held thereto by any suitable type of releasable fastener, such as exemplary hook and loop fasteners 138, 140. Additionally, a fold line 120 is preferably formed in the central support member 118 adjacent the rear end thereof. In use, when the user desires to dip the roller brush R into a paint reservoir, the central support member 118 (and the remainder of shield 100) may be flipped up about the fold line 120 to fully expose the roller brush R.

It is to be understood that the present invention is not limited to the embodiments described above, but encompasses any and all embodiments within the scope of the following claims.

We claim:

1. A shield for a paint roller, comprising:

a frame member having a pair of opposed side edges, a front edge and a rear edge;

a front wall mounted to the front edge of the frame member and extending substantially orthogonal to the pair of opposed side edges, the front edge and the rear edge thereof;

a rear wall mounted to the rear edge of the frame member, the rear wall being substantially parallel to the front wall, the front and rear walls defining an open region therebetween adapted for releasably receiving a roller brush of the paint roller therebetween so that an upper portion and a lower portion of the roller brush remain exposed;

means for releasably securing the frame member to an axle of the paint roller, wherein said means for releasably securing said frame member to the axle of the paint roller comprises at least one curved central portion of at least one side edge of said frame member, the at least one curved central portion being substantially semicircular; and an auxiliary cover sheet having opposed front and rear edges, the front edge thereof being attached to the rear edge of said frame member, the rear edge of the auxiliary cover sheet being adapted for releasable attachment to a supporting member of the paint roller adjacent a handle portion thereof.

2. The shield for a paint roller as recited in claim 1, wherein said frame member is substantially rectangular.

3. The shield for a paint roller as recited in claim 2, wherein said front wall is substantially rectangular.

4. The shield for a paint roller as recited in claim 3, wherein said rear wall is substantially rectangular.

5. The shield for a paint roller as recited in claim 4, further comprising a pair of opposed sidewalls.

6. The shield for a paint roller as recited in claim 5, wherein said rear wall extends upward from the rear edge of said frame member.

7. The shield for a paint roller as recited in claim 6, wherein said front wall has an upper portion and a lower portion, the upper portion extending upward from the front edge of said frame member, the lower portion thereof extending downward from the front edge of said frame member.

8. The shield for a paint roller as recited in claim 1, wherein the auxiliary cover shield has a fold line formed therein adjacent the rear edge thereof.

9. The shield for a paint roller as recited in claim 8, further comprising at least one auxiliary clip adapted for releasably securing the auxiliary cover sheet to the supporting member of the paint roller.

10. A shield for a paint roller, comprising:

a frame member having a pair of opposed side edges, a front edge and a rear edge;

a front wall mounted to the front edge of the frame member and extending substantially orthogonal to the pair of opposed side edges, the front edge and the rear edge thereof, the front wall having an upper portion and a lower portion, the upper portion extending upward from the front edge of the frame member, the lower portion extending downward from the front edge of the frame member;

a rear wall mounted to the rear edge of the frame member, the rear wall being substantially parallel to the front wall, the front and rear walls defining an open region therebetween adapted for releasably receiving the roller brush of the paint roller so that an upper portion and a lower portion of the roller brush remain exposed;

means for releasably securing the frame member to an axle of the paint roller, wherein said means for releasably securing said frame member to the axle of the paint roller comprises at least one curved central portion of at least one side edge of said frame member, the at least one curved central portion being substantially semicircular; and an auxiliary cover sheet having opposed front and rear edges, the front edge thereof being attached to the rear edge of said frame member, the rear edge of the auxiliary cover sheet being adapted for releasable attachment to a supporting member of the paint roller adjacent a handle portion thereof.

* * * * *